United States Patent [19]

Shaw et al.

[11] Patent Number: 4,813,493

[45] **Date of Patent: * Mar. 21, 1989**

[54] HYDRAULIC TOP DRIVE FOR WELLS

[75] Inventors: Danial G. Shaw, Conroe; Billy MacCline, Houston, both of Tex.

[73] Assignee: Triten Corporation, Houston, Tex.

[ * ] Notice: The portion of the term of this patent subsequent to Jun. 28, 2005 has been disclaimed.

[21] Appl. No.: 38,877

[22] Filed: Apr. 14, 1987

[51] Int. Cl.[4] ..... E21B 3/00

[52] U.S. Cl. ..... 173/164; 81/57.34; 166/77.5

[58] Field of Search ..... 173/163, 164; 175/85, 175/52; 81/57.16, 57.34; 166/77.5

[56] References Cited

U.S. PATENT DOCUMENTS

| | | | |
|---|---|---|---|
| 3,191,450 | 6/1965 | Wilson | 74/219 |
| 3,312,294 | 4/1967 | Wilson | 173/164 |
| 3,380,324 | 4/1968 | Hillman | 81/54 |
| ',623,558 | 11/1971 | Brown | 173/57 |
| 4,458,768 | 7/1984 | Boyadjieff | 175/85 |

*Primary Examiner*—Donald R. Schran
*Assistant Examiner*—James L. Wolfe
*Attorney, Agent, or Firm*—Vaden, Eickenroht, Thompson & Boulware

[57] ABSTRACT

Well apparatus including a top drive assembly having a hollow drive stem driven through a gear assembly by a plurality, two or more, of hydraulic motors, the drive stem adapted to be attached to a well swivel at upper end and an intermediate sub or a string at the lower end, the rotary motion of the drive stem to power the string during operations. A shut off valve to shut off well fluid and a link adapter can be located between the lower end of the hollow drive stem and the upper end of the drill string. The vertical axis of the drive stem can be aligned coaxially with the vertical axis of the wellbore and with the vertical axis of the drill string. The top drive can be mounted to a wheeled support frame contained within two elongated members mounted in a derrick. Pivotably mounted to the support frame is a manipulator arm adapted on one end to grasp and support a tubular member and pivotable in a horizontal plane. Also mounted to the support frame is a pipe wrenching device which is extendable toward or retractable from a position coinciding with the well centerline.

1 Claim, 18 Drawing Sheets

130
130
129
131
136
135
126
132
133
129
11
134
137
143
138
11

140
139
138
135

187a
187b
179
186
180
188
180
182
176a
174
176b
178
17
183
181
185
185a
175
184
17
177

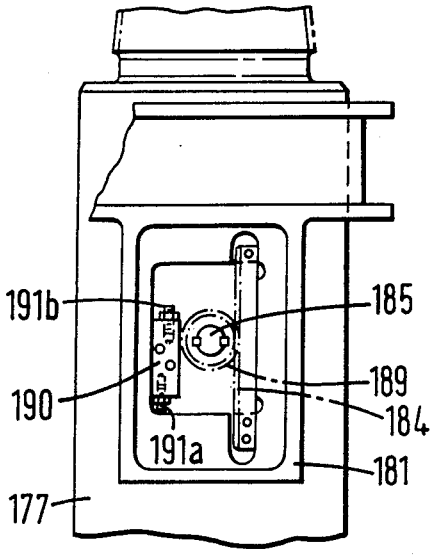
FIG.17
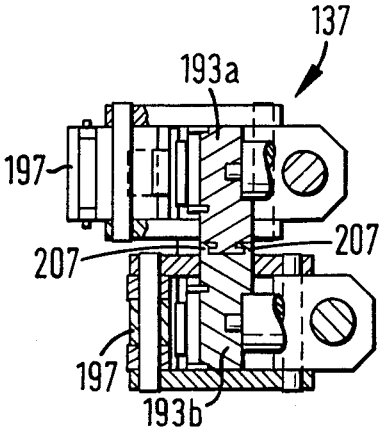
FIG.22
FIG.19a
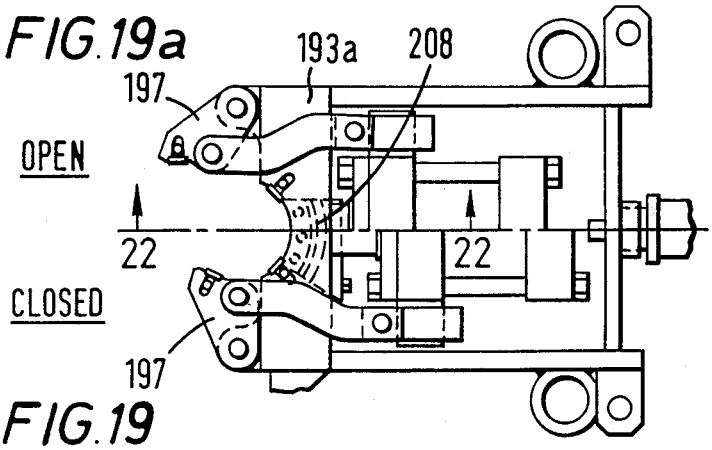
FIG.19

HYDRAULIC TOP DRIVE FOR WELLS

BACKGROUND OF THE INVENTION

1. Field of the Invention

This invention relates to top drive well drilling, operations, apparatuses, equipment and particularly to improved input driving power, improved pipe handling systems, improved pipe wrenching means, improved dolly roller system and improved support means for pipe elevator links.

2. Description of the Prior Art

It has previously been common in well drilling and other well operations to impart motive force to the drill string or other tubular members by means of the old rotary table drive apparatuses or by electric motor top drives. The old rotary drive tables are inefficient and costly. The electric top drives have had numerous problems; for example, to move and support drill strings weighing up to 500 tons, the direct current traction motors used in electric top drives must be very large, consequently they require a large and effective motor cooling system. Also all of the safety problems associated with electricity are considerations when using an electric top drive. Because of these shortcomings, obtaining compliance with accepted safety codes and insurance certification for the use of electric top drives has been a tedious, expensive, and time-consuming process. There are also numerous structural/functional disadvantages associated with the use of electric top drives; for example, some prior art electric top drive utilizes an expensive thrust bearing to support the drill string rather than using the shaft of the motor itself. Other prior art electric top drives have an electric motor which is offset from the shaft supporting the drill string The central drive shaft of the electric motor is not directly connectable to the drill string nor is it directly connectable via an intermediate sub or other member. Therefore, a means for transferring rotative force from the electric motor to the drill string must be employed; e.g. a system of reduction gears between the motor and a tubular member which is connectable to the string. This results in an imbalance in the distribution of the reactive torque applied to the string.

One type of top drilling drive previously utilized includes pipe handling mechanism suspended below and connected to the top drive gear box (see U.S. Pat. No. 4,449,596). This top drive also utilizes a pipe wrenching device supported in suspension from the gear box and both its pipe handling mechanism and the pipe wrenching device are permanently disposed about the tubular drive shaft projecting from the bottom of the top drive. In actual operation, the pipe wrenching device is actuated upwardly to engage splines located about the circumference of the tubular drive shaft. When drill rotation is stopped, the pipe wrenching device can be used to break a threaded connection between the powered drive unit and the drill string, and the pipe handling mechanism can then support the drill string remaining in the drill hole. This top drilling drive utilizes an electric motor to impart the necessary rotary motion to the drill string. Utilities, cables, and other connections to the top drive to the electric motor must of necessity be flexible since they must travel up and down with the top drive.

The previously described top drilling drive assembly has had a number of operational disadvantages. When providing power to the drive motor, rubber covered flexible conductors are provided. These conductors are largely unprotected from accidental short circuits which might occur if the cable were pinched between two metal objects Since all drilling rigs are located in hazardous areas this could be life threatening. The electric motor must also be cooled and the cooling air is transported through flexible ducts which are very prone to failure if they are of a flimsy nature. The motors must be completely sealed to prevent the emission of sparks from the carbon brushes. This has proved to be very unreliable. Another disadvantage has been the pipe wrenching device. This tool requires hydraulic fluid conductors directed to the working mechanism. Since in operation, the top drive shaft which supports the wrenching device, must rotate, this demands that a high pressure rotary fluid connection must be provided on the top drive shaft. This is very costly and unreliable. Such a large diameter rotary joint at higher pressures is not reliable. Remotely operated shut-off valves have failed. These valves all utilize a ball with a hole through the center through which passes abrasive drilling fluids. The present valves do not provide a satisfactory method of ensuring the ball is fully open or closed. When the ball is not oriented properly, fluid passage will erode the ball very quickly.

The drill pipe pick up tool requires tilting the top drive central shaft about its vertical axis to pick up a new section of pipe. With this method it is impossible to pick up a length of drill pipe without exerting extreme pressure on the side of the pipe. This results in undue wear on the drill pipe and also the "mouse hole." (A "mouse hole" is a hole near the rig in which pipe is placed for pick up).

Other operational disadvantages of the top drive of U.S. Pat. Nos. 449,596 and 3,766,991 include the fixed rollers on the "dolly." This fixture secures all the other top drive components to the derrick guide rail system. Since there is no flexibility in the dolly roller system to compensate for irregularities, many roller failures have been experienced in the field. It has been difficult to obtain certification for use of electric top drives in hazardous areas. Because of the electrical and the cooling system requirements, several safety devices in the form of electrical switches must be provided. Individual components require certifications and the entire installation must be approved by a recognized authority. This is very time consuming and expensive. The prior art hydraulic top drives such as taught in U.S. Pat. No. 3,994,350 has a hydraulic motor which is offset from the centerline resulting in an imbalance of loading of the central shaft. An endless chain is driven by the hydraulic motor and the chain, in turn, drives a drive unit which can be threadedly connected to pipe.

SUMMARY OF THE INVENTION

The present invention is directed to a hydraulic top drive apparatus and to a tubular handling device that overcome the problems associated with the prior art devices. Mounted in a derrick beneath a conventional crown block, traveling block, bail, and swivel, the present invention includes a hydraulically powered top drive pipe rotating device having a single hollow drive shaft with threads at each end for mating on one end with the drill string or tubular to be worked and on the other with a drilling swivel. This shaft can be positioned coaxially with the vertical axis of both the wellbore and the drill string so that a balanced concentric force is imparted to the string. The top drive rotating device is attached to a wheeled support frame. The frame moves on guide rails which are mounted to the derrick. The mounting of the top drive apparatus permits it to be pivoted levelly in a horizontal plane away from the vertical axis of the wellbore and of the drill string or other tubulars. Motive force is applied directly to the drill string or other tubular being worked. Also, the top drive is fully reversible so that motive force can be applied in either direction. A makeup/breakout wrenching device is retractably connected to the wheeled support frame. It is movable independently of the top drive and is positioned beneath the top drive. A pipe lifting and positioning device is mounted beneath the top drive on the wheeled support frame for picking up pipe and for positioning it so that the pipe threads can mate precisely with the threads of the top drive shaft. The drillpipe lifting and positioning device may be extended as desired—this allows picking up pipe from a "mousehole". Also the device's ability to rotate makes the radial location of mousehole unimportant. The device is adjustable in the three motions available; degree of rotation, length of extension and height of elevation. Thus, the operator can pre-set the degree of the various motions and then, by simply turning a valve handle, effect the desired action which is automatically accomplished with the hydraulic sequencing valves. Presently available systems require more manual effort. Also, other systems after picking up the pipe, lower the pipe (sometimes as much as 1900 lbs) into the mating thread. This undue force rapidly wears and sometimes damages the threads. Apparatus according to the present invention raises the drill pipe toward an already rotating mating thread. Since the upward thrust can be accurately controlled by adjusting a valve, thread life can be greatly extended. The present invention provides a semi-automated drilling system, which is more precise and which reduces human error.

A top drive drilling system embodying the present invention includes a hydraulically powered drive head which eliminates the inherent safety problems present with electrical equipment in an oil well drilling derrick.

A top drive drilling system according to the present invention can include a drill pipe handling mechanism which is mounted independently from the top drive central shaft both eliminating the need for a tilting mechanism, and increasing the versatility of the tool since the pipe handling mechanism can be programmable to reach any required pick up location required within the confines of the drill floor. The pipe lifter/positioner can elevate drill pipe to connect it to the drill stem. Since the pipe wrenching tool can be mounted independently of the top drive rotating shaft, the need for a rotating high pressure hydraulic coupling is eliminated. Prior art U.S. Pat. No. 4,449,596 teaches a device which suspends a hydraulically powered wrenching tool directly below the drive motor gear box. This wrenching tool is subsequently engaged to the centrally located rotating shaft through the use of mating splines. Since fluid conductors must be employed to drive the tool, some form of rotary seal must be used (which often must seal effectively when fluid pressures approach 2000 p.s.i.). The device of U.S. Pat. No. 4,529,045 as fitted to the top drive of U.S. Pat. No. 4,449,596 accomplishes the transfer of fluid. This wrenching means can also be provided with a mechanism which will retract the tool completely away from the well centerline. The same mechanism can extend the assembly to the proper position from which to grip and wrench the drill pipe joint.

A particular feature of the top drive power head according to this invention is the use of input pinion drive gears. The input gears contain a female spline which is fitted with a splined sleeve. Whereas the outside spline is machined to fit the gear, the female spline is machined to fit the various sizes of hydraulic motors. This allows a change in horsepower simply by changing to a larger or smaller motor and an appropriate splined sleeve.

Another feature of various embodiments of the present invention is that both the pipe lifter/positioner and the pipe wrenching means may be easily swung or retracted away from the centerline of the well. When withdrawing a drill string from the hole, the spiral shape of the customary drill pipe stabilizers impart a rotary motion to the drill stem. When this happens, the elevator links and the drill pipe elevators must of necessity rotate also. The present invention allows this to happen naturally since the pipe wrench and the pipe positioner are mounted independently of the drive mechanism.

The present invention discloses an improved operator for the remote shut off valve. The design is such that the open/close limits of the valve ball operating mechanism can be positively set before installation in the drill string. The cylinders which operate the valve shift yoke have an adjustable stroke which can be affected by external adjustments. The rack and pinion operator provided is also less susceptible to wear and will hold its adjustment indefinitely. The present invention also discloses a quick disconnect which may be used to connect the top drive unit to the drilling swivel normally found directly below the drill rig traveling block. It is very inconvenient and also dangerous to operate rig pipe tongs at an elevation of 8 to 12 feet above the drill floor. The present invention allows the making or breaking of this threaded connection without using a tong. Counterbalance cylinders according to the present invention are located between the drilling swivel and the traveling block. In the event of malfunction, this component is easily removed for service. The design also allows a shorter overall assembly length which facilitates usage in a shorter derrick. Many prior art units require so much derrick space that derrick rework to increase the height becomes necessary.

Using apparatus according to the present invention allows drilling down to the drill floor. Prior art units are able to drill to within only 3–4 feet of the floor. Even to do that, prior art units require a mechanism to elevate the pipe handling equipment in a vertical direction. This is both cumbersome and inefficient.

The present invention discloses pipe wrenching means in which one set of the pipe wrench jaws are operable when selected to be in such a mode. This allows the pipe wrench to act as a drill stem locking brake. The operator will select the proper action by manipulating a valve. This feature is valuable since it is desirable to lock the drill stem when directional drilling and checking the down hole orientation with instruments. The drill pipe positioner arm control system of this invention is versatile. The pickup arm may be controlled with conventional hydraulic components, but it is also adaptable and may be fitted with solid state electronic controls. Although these controls are electrical, they are intrinsically safe and usually are not able to ignite explosive gases. The electronic control is programmable which greatly improves the efficiency of the pipe manipulator arm. According to the present invention a driller can be provided with a control "box" which has among other features various potentiometers. These adjust a command signal to actuator cylinders which contain linear variable displacement transducers which send a feedback signal to the control "box". When the input signal and the feedback are equal, the hydraulic supply to the cylinder is cut off.

At the outset of drilling the operator can set the rotation limit potentiometer, the extend distance potentiometer and the lift limit potentiometer. Once this is done, by flipping a switch all three actions occur in correct sequence and accurately.

The pipe positioner mounting frame according to this invention can have a plurality of guide roller/bracket assemblies. Each roller complex can include two spring loaded rollers which allow shock absorber action in two dimensions. This design has two distinct advantages: the cushioned support reduces vibration and stress on the top drive and it also allows the guide rail installation inaccuracies to be compensated for. Since the spring tension is adjustable, each installation may be custom fitted.

A top drive drilling system according to the present invention can provide a rotary drive powered drilling head utilizing fluid power. Fluid energy is inherently smoother and produces fewer shock loads than mechanical forms of energy. This feature is extremely important since drill pipe twisted off several thousand feet below the surface presents many problems. The torque applied by fluid motors is smoother and causes less over-tightening and swelling of drill pipe threaded connections. When drill pipe breaks, an electric motor will inherently overspeed when the load is suddenly removed. This can be very dangerous. Prior art units have in many cases been required to add an overspeed switch and brake to prevent runaway. Hydraulic motors will not overspeed because pump displacement controls their speed and a sudden break will simply lower the pressure. The incompressible fluid can dynamically inhibit runaway.

The pipe lifter/positioner arm can include a pivoted pickup bowl which is fitted with energy absorbing springs to reduce shock damage to drill pipe. The pickup bowl is also hard surfaced at points in contact with drill It is, therefore, an object of the present invention to provide an efficient and safe hydraulic top drive for use in well operations.

Another object of the present invention is the provision of such a top drive which imparts a concentric and balanced motive force to the tubular to be worked.

Yet another object of the present invention is the provision of means for pivoting the top drive pipe handling apparatus levelly in a horizontal plane away from the drill string or other tubulars being worked without having to tilt the top drive from the vertical.

A further object of the present invention is the provision of such a top drive apparatus in which its shaft itself supports the drill string so that no thrust bearing support is required.

Another object of the present invention is the provision of such a top drive apparatus in combination with a pipe lifting and positioning device in which: both of them are mounted on a wheeled support which in turn is mounted on rails connected to the derrick for moving the top drive apparatus and pipe positioning device up and down within the derrick; in which they are both movable to some extent with respect to the frame itself; and in which they are both mounted and movable independently of the top drive.

Yet another object of the present invention is the provision of such a top drive in which the pipe positioning device can be pivoted levelly in a horizontal plane away from the drill string or other tubular being worked without having to tilt it from the vertical.

A further object of the present invention is the provision of such a hydraulic top drive apparatus in which full rated torque output can be achieved within safe operating limits.

Another object of the present invention is the provision of a device for precisely lifting and positioning drill pipe.

Yet another object of the present invention is the provision of a hydraulic top drive apparatus which limits the lifting distance of the drill bit off the bottom of the hole when making connections of pieces of the drill string. Since drilling down flush with the drill floor is possible with devices according to the present invention, to elevate the pipe far enough to set the slips (wedge-shaped support devices) requires that the drill bit be moved only about three feet from bottom. Prior art top drives require elevation of six to eight feet and the old Rotary/Kelly method requires elevations of thirty-four to thirty-six feet.

Still another object is the provisions of such a top drive with which drill pipe connections may be broken at a wide range of elevations in the derrick and which provides smooth rotary torque at these elevations.

Another object of the present invention is the provision of such a top drive which can be utilized for normal drilling, reaming and casing operations, can be used to drill with single or multiple sections of pipe, and can ream in ninety-foot increments.

Yet another object of the present invention is the provision of a hydraulic top drive apparatus which can be used to connect tubular members without using spinning chains or tongs.

A further object of the present invention is the provision of such a top drive that has a rise and fall counterbalance system.

A further object of this invention is to ensure that the drive motor will not "run away" in the event of breakage of drill pipe. When drilling with a normal ninety foot stand of pipe, if the pipe breaks near the bottom of the stand, the sudden increase of electric motor torque would create an uncontrolled "whipping" of the pipe which is very dangerous.

To those of skill in this art who have the benefit of this invention's teachings, other and further objects, features and advantages of this new top drive will be clear from the following description of the presently preferred embodiments of the invention, given for the purpose of disclosure and taken in conjunction with the accompanying drawings.

BRIEF DESCRIPTION OF THE DRAWINGS

FIG. 17 is a plan view of the rack and pinion operator and the positive stop adjustment for stroke.

FIG. 19 is a plan view of the pipe wrenching device with a horizontal centerline separating a half view when open and a half view when closed.

FIG. 19*a* is a split plan view of the relative position of the die holders when open and when closed.

FIG. 22 is a sectional view of the pipe wrenching device.

DESCRIPTION OF THE PREFERRED EMBODIMENT

Figure 1:
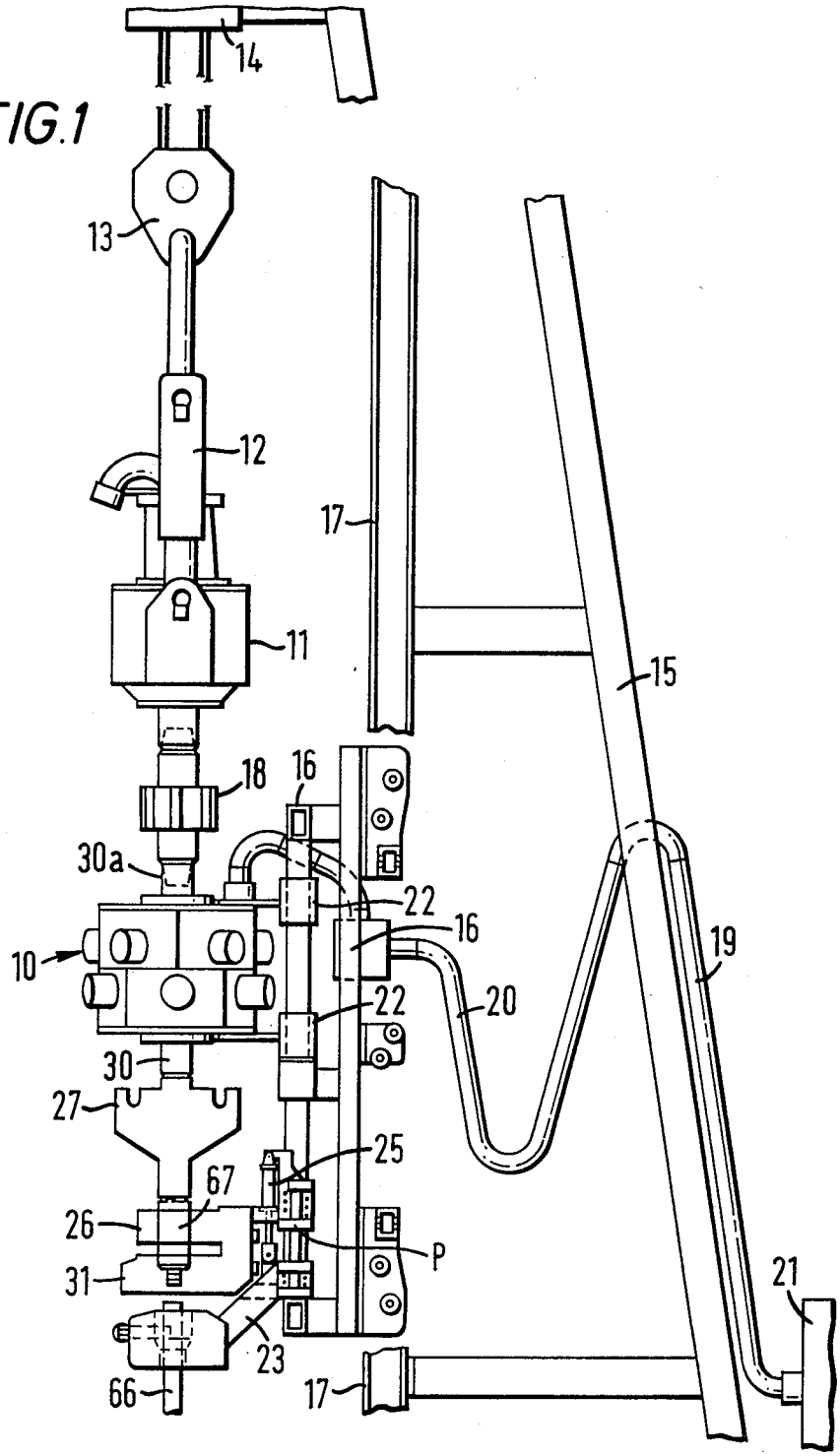
FIG. 1 is an elevational view of a derrick showing a hydraulic top drive according to the present invention.

Referring now to FIG. 1, a hydraulically powered drilling top drive apparatus 10 according to the present invention is suspended from a commercially available swivel 11 fitted with optional bail links 12 for counterbalancing. This swivel in turn is attached to a traveling block 13 which is attached by cables to a crown block 14 in the derrick 15. The top drive 10 is attached to a wheeled support frame 16 which is mounted upon guide rails 17 which are mounted to the derrick 15. The attachment of the drilling top drive 10 to the swivel 11 shaft may be made through a one piece threaded hollow shaft or by using a splined quick disconnect 18. The hydraulic fluid which operates the top drive 10 is conducted through pipes 19 and hoses 20 from a power unit 21 located at a convenient point. The top drive 10 has a hollow drive shaft with a threaded top end 30*a* for connection to the swivel 11.

The drilling top drive 10 is attached to the wheeled support frame 16 in such a manner that it may be rotated in a horizontal plane about pivots 22 on the wheeled support frames 16 for maintenance or removing from service. The drill pipe positioning arm 23 is also pivoted from the support frame 16 in such a manner that it may be rotated in a horizontal plane to a drill pipe pick up point using cylinders 24. The positioning arm may then be rotated to a point which positions the drill pipe 66 directly over the centerline of the well being drilled. Additional cylinders 25 then elevate the drill pipe 66 to allow a screwed connection to be made to either: the threaded bottom end of the top drive shaft 30, the threaded bottom end of the elevator link adapter 27 (when it is used), or to the threaded end of the saver sub 67 when it is used. Since the motive force of the top drive is centered about the central shaft 30, the reactive forces are balanced and a concentric balanced force is imparted to the drill string.

The wrenching device 26, 31 is also pivotably connected on the support frame 16 in such a manner that it may be rotated aside in a horizontal plane to allow access for maintenance or removal.

Figure 2:
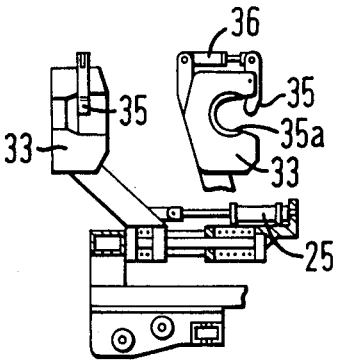
FIG. 2 is a side view of the pipe positioning and handling mechanism.
Figure 2A:
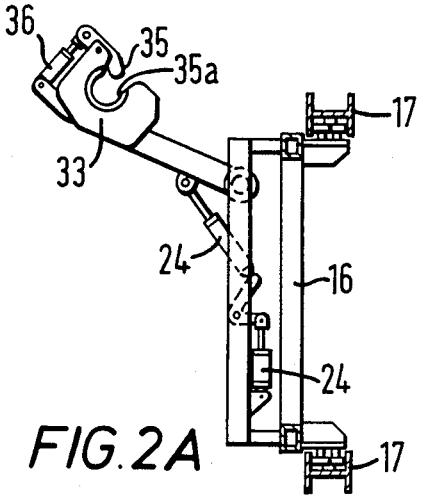
FIG. 2A is a top view of the device of FIG. 2.

Referring now to FIG. 2, the positioning arm bowl 33 is designed with a "U" shaped opening with a tapered seat to match the drill pipe tool joint. The latch arm 35 moves to allow the entry of drill pipe. The latch arm is spring loaded to the closed position. Drill pipe may be loaded by pushing into the opening 35*a*. A cylinder 36 is used to move the latch to the open position. Cylinder 25 when actuated, moves the drill pipe into contact with the mating thread on the top drive shaft 30. The latch may also be activated manually.

Figure 3:
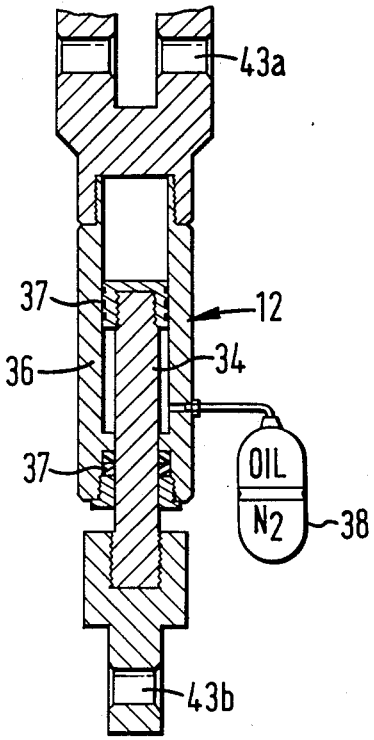
FIG. 3 is a sectional view of the bail link counterbalance.

Referring now to FIG. 3, the hydraulically cushioned bail link has a piston 34 which acts upward within the cylinder barrel 36 as a result of fluid under pressure entering the interior of the barrel 36. This internal force acts like a compression spring. When the rod 34 is actuated downward by a load the potential energy is stored within the chamber 38. As long as the load is more than the potential energy, the distance between the attaching holes 43*a* and 43*b* will be at maximum. When the load is next reduced such as when a section of drill stem is unscrewed, the distance between the attaching holes will decrease, the drill string proper will remain stationary in the hole, the drilling swivel 11 will move upward as the threaded members of the drill string separate, while the section being unscrewed is raised by the action of the piston 34 within the barrel 36 to an upward position. When the load is entirely removed, the hole through the centers of the attaching holes will be at minimum. Packing seals 37 maintain the pressure required to move the piston.

Figure 4:
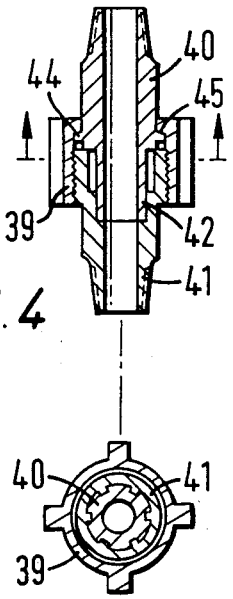
FIG. 4 is a sectional view of the splined quick disconnect.

Referring now to FIG. 4, a tubular member 40 containing a male spline and an extension bearing a sealing element 42 is inserted within a female spline contained in the threaded section 41. A threaded collar 39 is screwed to mate with the threads on the threaded member 41. An inside shoulder 45 on collar 39 shoulders against a projection 44 on member 40 and thereby locks the assembly as a splined and sealed unit. Torque is transmitted through the splines.

Figure 5:
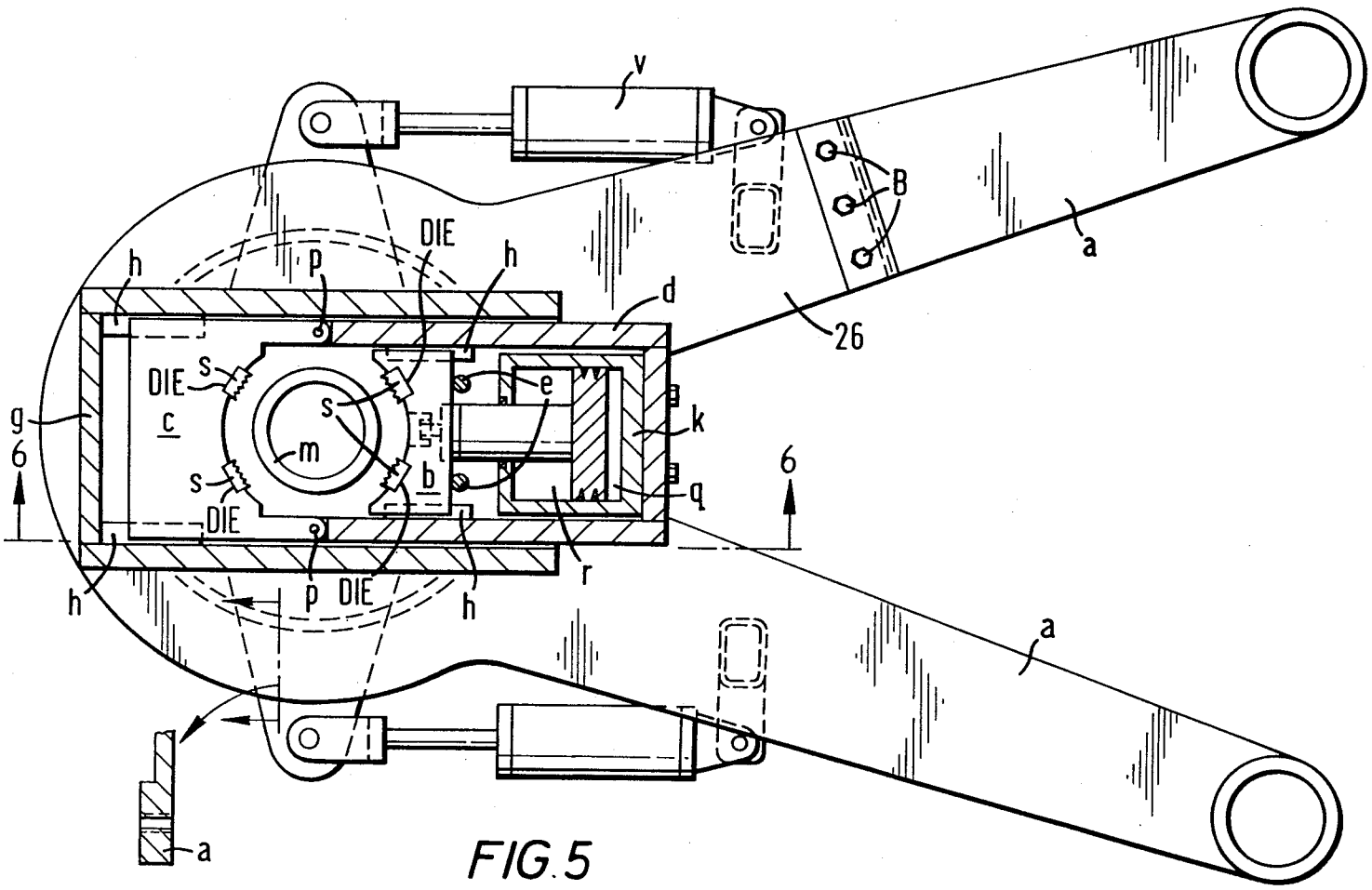
FIG. 5 is a top view partially in section of a pivotable breakout/makeup wrenching device assembly.

Referring now to FIG. 5, the wrenching device upper section 26 has the box section g securely attached to support members a. Die block c is attached to inner die carrier d. Blocks b and c are able to move inward or outward on guides h. Cylinder k when pressurized in chamber q moves block b into contact with tubular workpiece m. As block b engages workpiece m, a reactionary force moves inner die carrier d in a direction away from workpiece m until die block c which is attached to die carrier d is forced to engage workpiece m. In operation, pressure in chamber q creates a gripping force which firmly engages serrated dies s against the workpiece m, In the reverse action, cylinder k is pressurized in chamber r causing die block b to move away form workpiece m. After partial travel, block b will contact stops e which will cause the body of cylinder k and the inner die carrier d to move inward toward the workpiece m. This action forces the die block c away from workpiece m.

Figure 7:
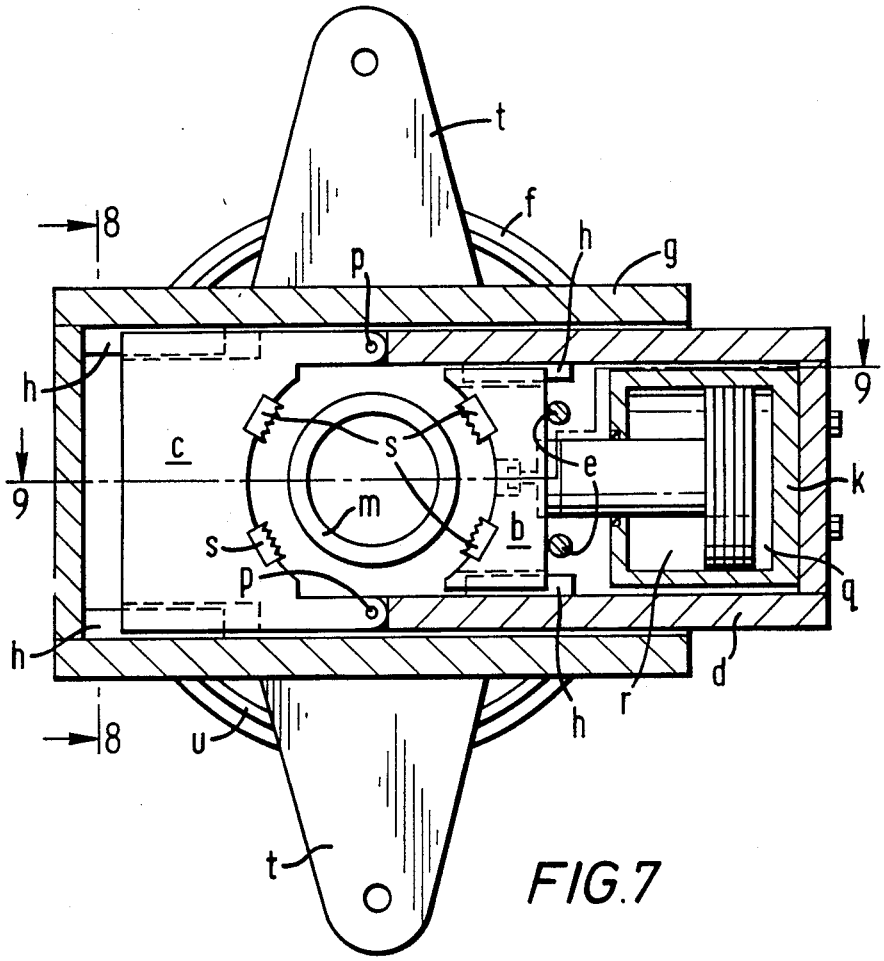
FIG. 7 is a bottom view partially in section of the lower section of the assembly of FIG. 6.

Referring to FIG. 7 which is a bottom view of the lower rotatable section 31 of the wrenching device, the box section g is securely attached to circular guide plate f. Die block c is attached to inner die carrier d with pins p. Blocks b and c are able to move inwardly and outwardly, being aligned by guides h. Cylinder k when pressurized in chamber q moves block b to contact tubular workpiece m. As block b engages workpiece m, a reactionary force moves inner die carrier d in a direction away from the workpiece m until dies block c engage workpiece m. In operation, pressure in chamber q creates a gripping force which firmly engages serrated dies s against workpiece m.

In the reverse action, the cylinder k is pressurized in chamber r causing die block b to move away from workpiece m. After partial travel, block b will contact stopes e which causes the body of cylinder k to move toward the workpiece m. Since inner die carrier d is attached to cylinder k, die carrier d will move toward workpiece m, the force being transferred through pins p which attach die block c to inner die carrier d. Torque are t are securely attached to box section g.

Figure 8:
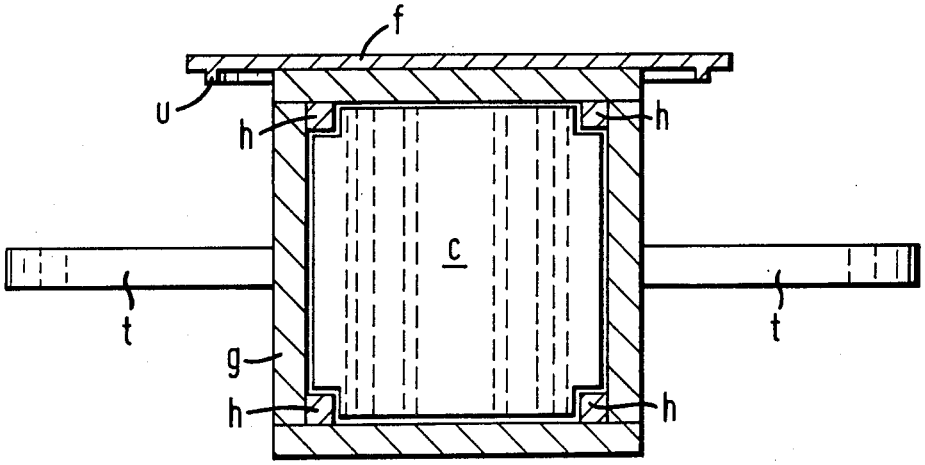
FIG. 8 is a sectional view of the assembly of FIG. 7.

Referring now to FIG. 8 which is a sectional view of the apparatus shown in FIG. 7, the circular guide plate f features a guide lip u which will be used in attaching the assembly of FIG. 7 to the upper section of the wrenching device shown in FIG. 5.

Figure 9:
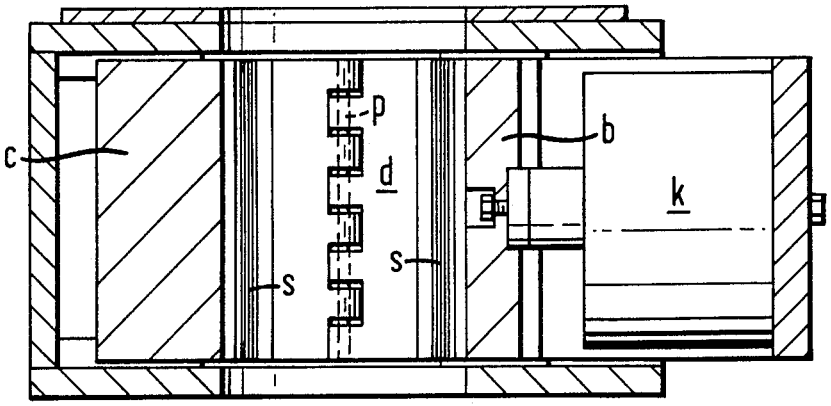
FIG. 9 is a sectional view of the sperling power clamping apparatus of the assembly of FIG. 6.

Referring now to FIG. 9, a typical section through either the top wrenching section or the lower wrenching section is shown in illustrating the method of attaching an inner die carrier d to a die block c using a pin p.

Figure 6:
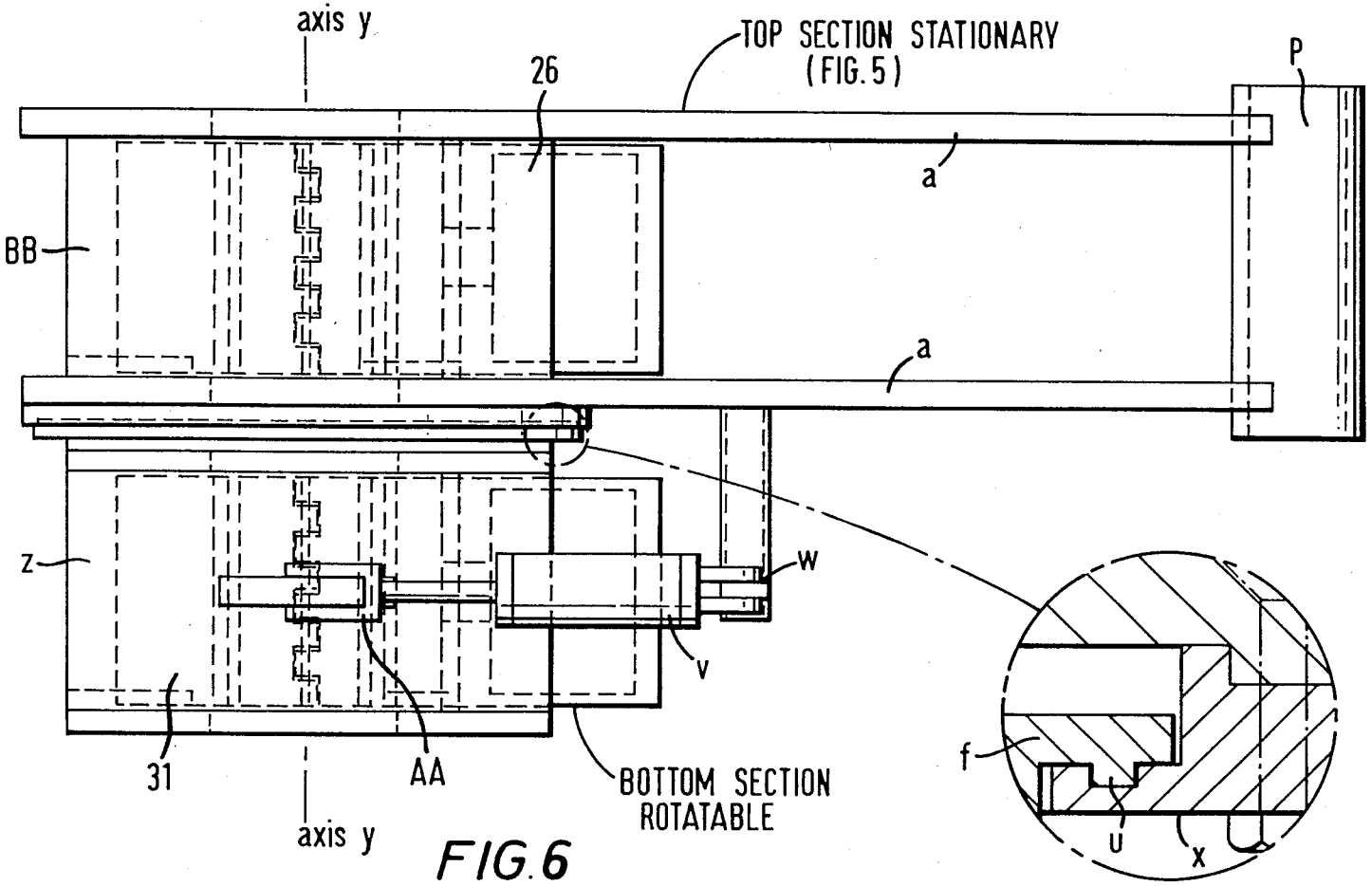
FIG. 6 is a side view of the assembly of FIG. 5.

Referring now to FIG. 6, the cylinders v are affixed to the lower section z of the wrenching device through a clevis AA at the rod end. The barrel end is connected to the upper section BB through a hinged joint w and the reaction is restrained by the upper section BB. When the cylinders are energized, the lower section will rotate the centerline of the guided die blocks about axis y. The annular groove and tongue u and x align and secure the upper and lower halves together while allowing rotary motion. When the bolts B are removed the wrenching device is free to pivot in a horizontal plane about point P as shown in FIG. 1.

With this invention, well drilling fluids enter the drill string through a conventional flexible hose connected to the swivel 11 shown in FIG. 1. The swivel has a hollow shaft through which fluids pass into the hollow shaft 30 of the top drive 10 and on through the hollow sections of the remaining subs or devices into the interior of the drill string.

Figure 10A:
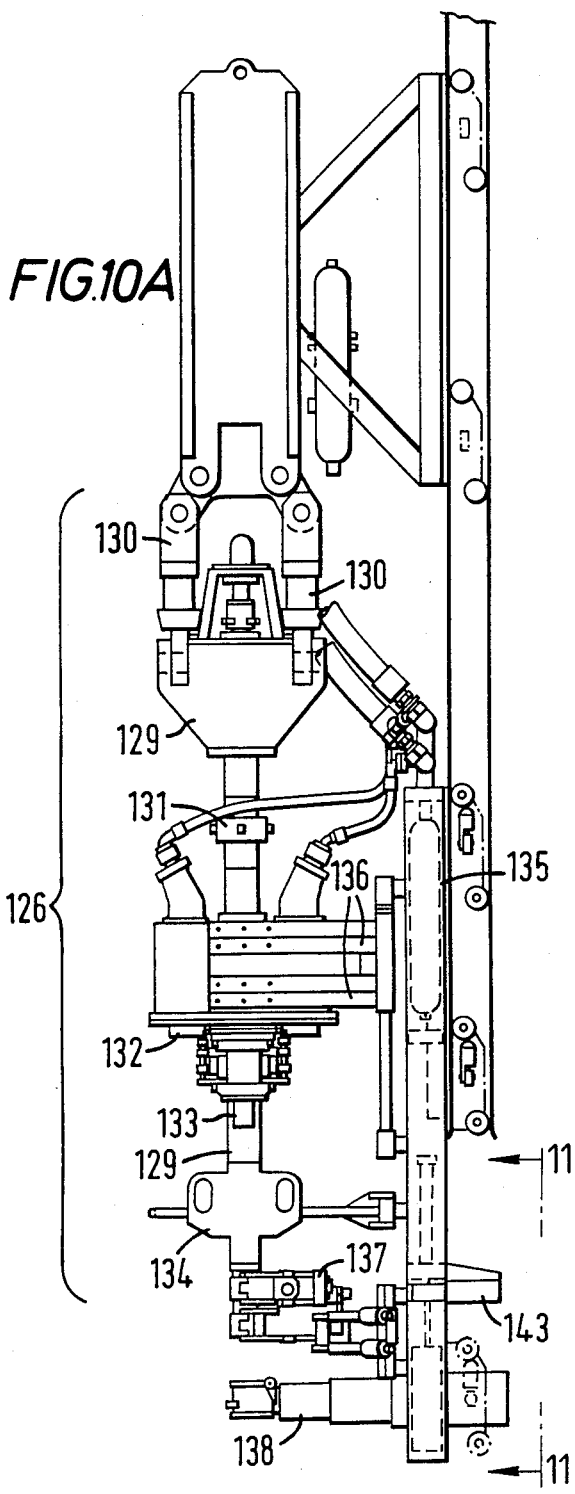
FIG. 10A is a side elevational view showing an enlarged view of a well drilling rig having a top drive assembly, providing pipe handling and wrenching mechanisms, remote shut off valve,, pipe elevator handling mechanism, quick disconnect mechanism and pipe positioner mounting frame constructed in accordance with the present invention.

Referring to FIG. 10*a*, an expanded side view of a top drive 126 is shown. The swivel 129 is fitted with special counterbalance links 130. Below the swivel is a quick-disconnect 131 which attaches a hydraulically powered drive unit 132 to the swivel. Below the hydraulically powered drive unit 132 is attached a shut off valve 133 and an elevator link adapter 134. The drive unit 132 is connected to a mounting frame 135 with mounting brackets 136. Attached to the mounting frame 135 is a retractable wrenching device 137 and a drill pipe manipulator 138. A wrenching device retract cylinder 143 is also shown.

Figure 11:
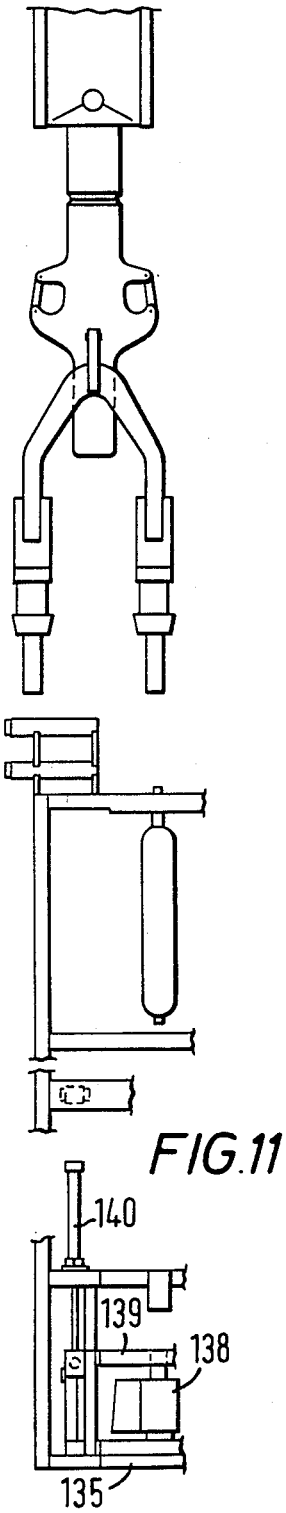
FIG. 11 is a half rear view of the pipe position gimball.

Referring to FIG. 11, a partial rear view of a mounting frame 135 is shown with a pipe manipulator 138 pivotally mounted to a manipulator gimball frame 139. Also shown are lift cylinders 140 that elevate the gimball 139 and the manipulator arm 138 to automatically engage the threads of a new section of drill pipe during a drilling operation.

Figure 12:
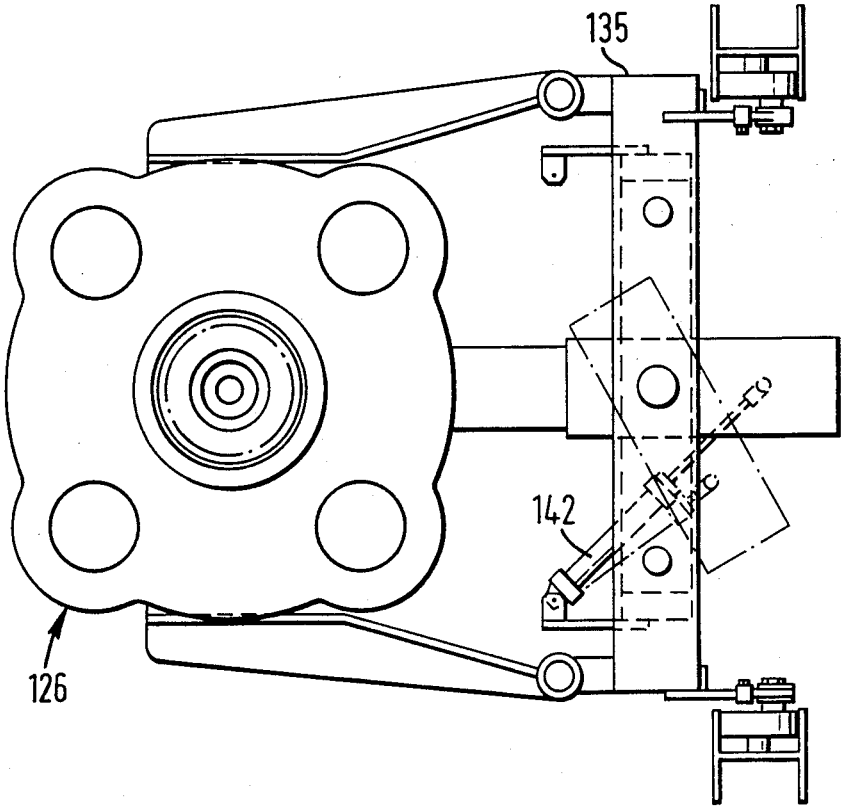
FIG. 12 is a view looking up at the top drive as mounted within a typical derrick.

Referring to FIG. 12, a top drive installation showing the method of attaching the top drive assembly 126 to the mounting frame 135 is shown. Also shown is a manipulator arm rotate cylinder 142 which rotates the positioner to the desired angular position in the derrick—ideally toward the drill pipe racking board.

Figure 13:
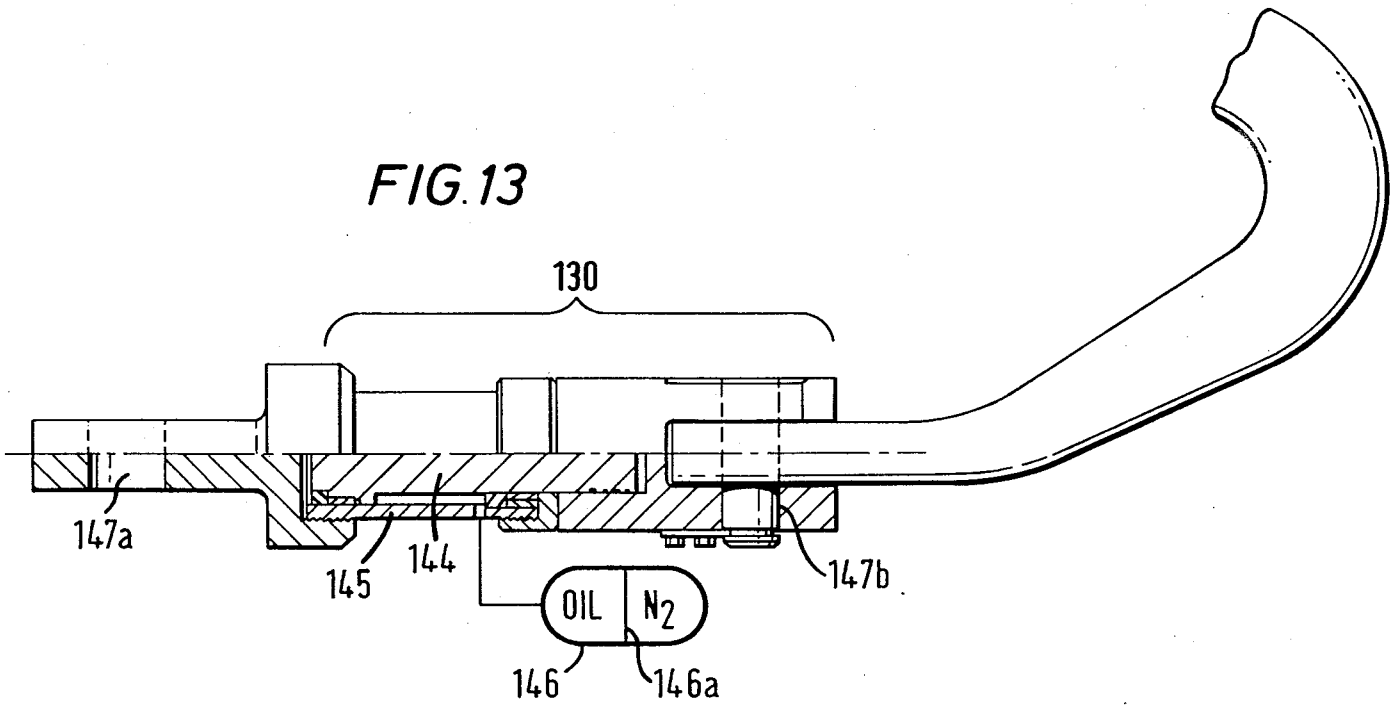
FIG. 13 is a sectional view of the counterbalance link assembly.

Referring to FIG. 13 a counterbalance mechanism 130 is disclosed in which a hydraulically cushioned bail link 130 has a piston 144 which acts upwardly in a cylinder barrel 145 as the result of fluid entering the barrel 145 under pressure. This mechanism counter balances the weight of the drill string or tubular being added to the existing string. This internal force acts like a compression spring. When a rod 144 is actuated upward by a load, the energy is stored within an accumulation chamber 146. The gas in the chamber (such as nitrogen) is separated from the hydraulic fluid (e.g. oil) by a movable member 146*a*. As long as the load exceeds the potential energy, the distance between the attaching holes 147*a* and 147*b* will be at maximum. When the load is next reduced, such as when a section of drill stem is unscrewed, the distance between the attaching holes will decrease, allowing the upper tubular element to raise up out of the threaded element stationary in the drill hole. The link assembly 130 may be used either with a lifting bail or with straight bail links.

Figure 14:
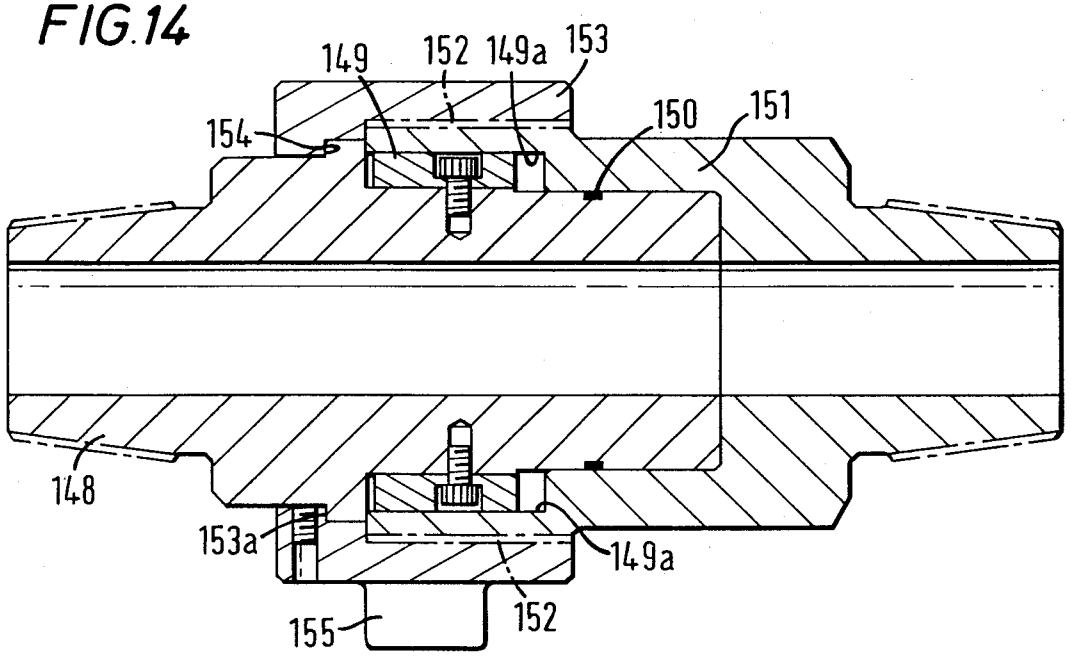
FIG. 14 is a cross sectional view of the quick disconnect assembly

Referring now to FIG. 14, a quick disconnect (which allows disconnecting the top drive without specialized tools) is shown having a tubular member 148 containing keys 149 and an extension bearing a sealing element 150 which is inserted within a bore in a tubular member 151 which contains key slots 149*a* to mate with keys 149 and threads 152. A threaded collar 153 is screwed to mate with the threads 152 on the tubular member 151. An inside shoulder 153*a* on collar 153 shoulders against a projection 154 on the tubular member 148. The collar 153 is provided with hammer lugs 155 for use in tightening threads.

Figure 15:
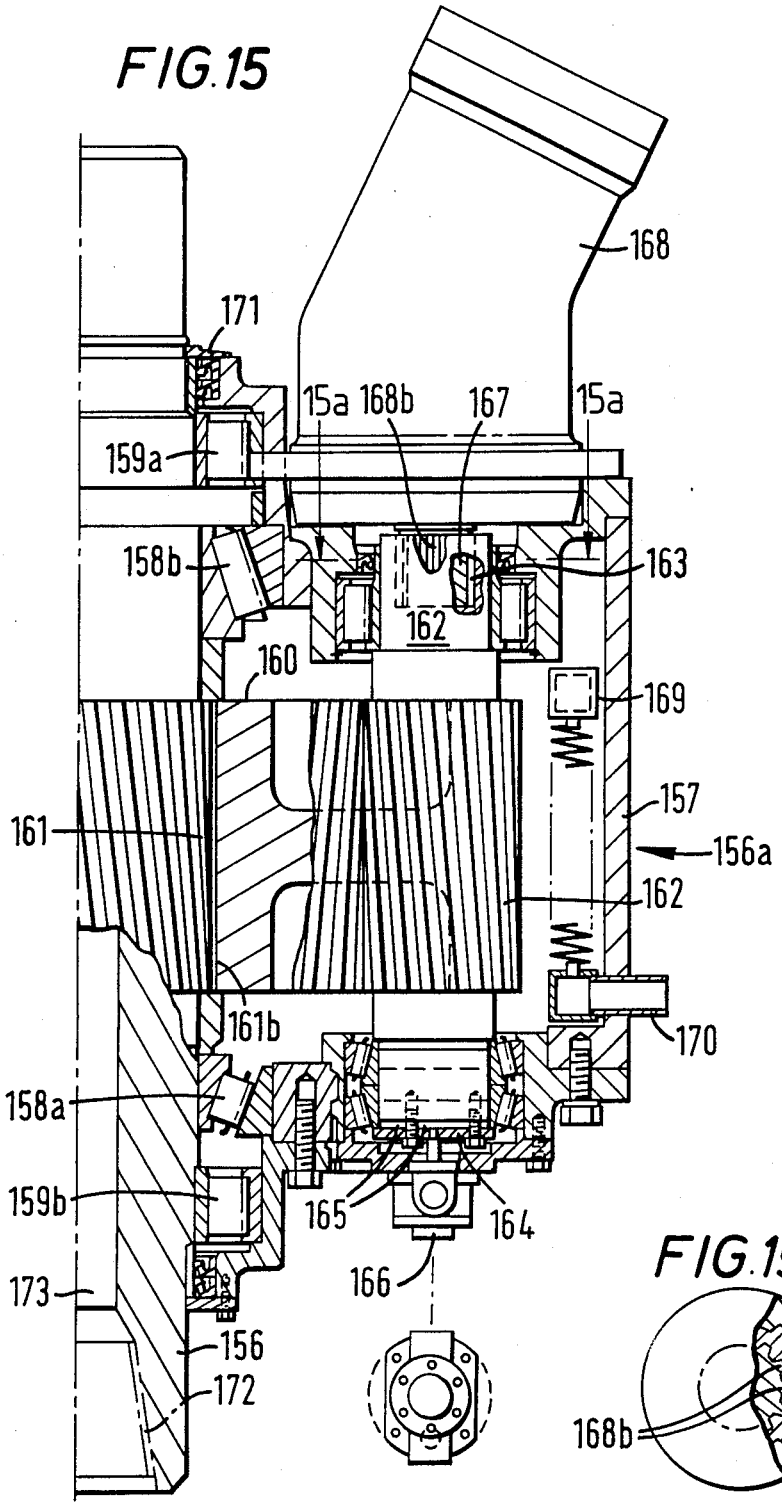
FIG. 15 is a half sectional view of the top drive power head.
Figure 15A:
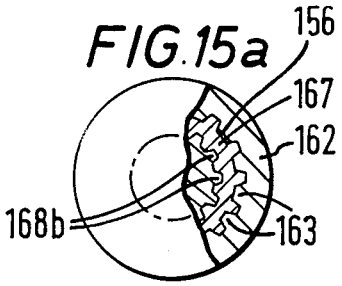

Referring now to FIG. 15, a gear box 156*a* is shown having a tubular member 156 which extends through a housing 157 and is constrained by thrust bearings 158*a* and 158*b* and radially supported by steady bearings 159*a* and 159*b*. The gear box transmits the motive power to turn the central shaft 156. A gear 160 containing a female spline 161 is mated to a tubular member 156 which has a matching male spline 161*b*. Pinion gears 162 are fitted with a female spline 163 on one end and a retainer plate 164 on the opposite end. The retainer plate 164 contains a slot 165 which drives an oil pump 166. A splined adapter 167 containing both male and female splines is mated with pinions 162. Motors 168 are fitted with male splined shafts 168*b* which are inserted within the pinion female spline 163. By coordinating spline sizes, various sizes of motors may be installed without changing any internal components. An oil to water heat exchanger 169 is installed within the housing 157 and cooling fluid is pumped through connector 170 to cool the gear box. Typically, about 60 gallons a minute of water is pumped through the heat exchanger thus cooling the gear oil (about 55 gallons) in the gear box . An excluder seal 171 is fitted to tubular member 156. Oil field type threads 172 are cut in both ends of tubular member 156 and a bored hole 173 is completely through tubular member 156.

Figure 16:
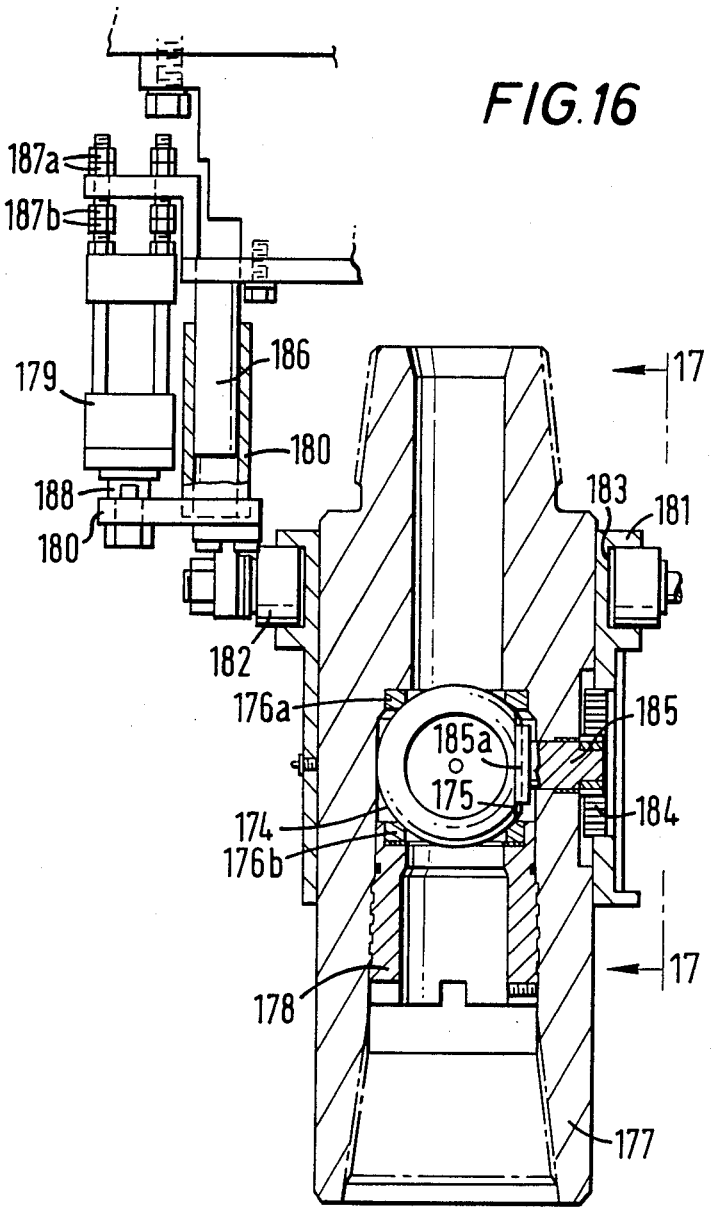
FIG. 16 is a sectional side view of the remote shutoff valve and a partial, view of the operating mechanism attachment to the top drive.

Referring now to FIGS. 16 and 17, a safety valve for shut off of the flow of liquids through the hollow drive shaft is shown having a hollow ball 174 containing a drive slot 175 which is installed with sealing elements 176*a* and 176*b* within a tubular member 177 and threadedly locked in place with threadedly locking plug 178. Cylinders 179 when actuated move cylinder bracket 180, which then moves shift yoke 181 through the action of rolling element bearings 182 against an annular slot 183. This moves the gear rack 184 longitudinally in or out, which rotates a valve stem 185. A male slot 185*a* on valve stem 185 rotates valve ball 174. Guide posts 186 precisely locate a cylinder bracket through a system of lock and spacer nuts 187*a* and 187*b*.

Thru the correct adjustment of lock and spacer nuts, 187*a* and 187*b*, a dead band is created allowing the cylinder outer housing to move without actuating the cylinder rod 188. When the cylinder is compressed it will move a short distance before a reaction takes place against spacer nuts 187*a* and 187*b*. When expanded the cylinder will move a short distance before a reaction takes place against spacer nuts 187*b*.

When the cylinder is actuated, it must move a small distance before activating the rod. This provides an infinite stroke adjustment and cuts the mud flow through the hollow shaft of the motor on and off (operator activated) and can remotely cut off the fluid passage to prevent well gasses from blowing out the drill hole.

Referring to FIG. 17, a pinion gear 189 is shown which when actuated by movement of the rack 184 rotates the valve stem 185. A stop block 190 is secured to a tubular member 177. Threaded pins 191*a* and 191*b* in stop block 190 are then accurately adjusted to limit the travel of the shift yoke 181.

Figure 18A:
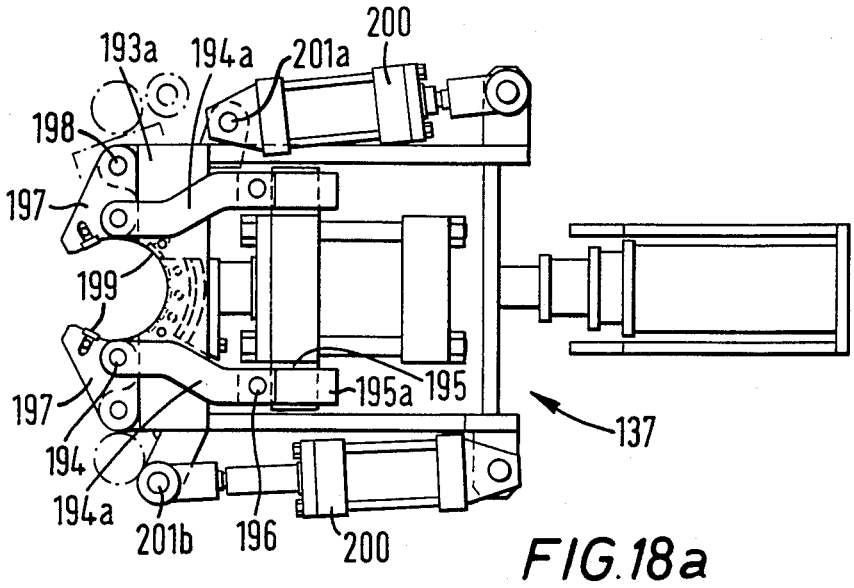
Fig 18 is a plan view of the pipe wrenching device.

Referring to FIGS. 18*a* and *b* and 19 and 22, a pipe wrenching device 137 is shown having a clamp cylinder rod 192*a* which is fastened to an upper die block 193*a* (FIG. 22) with a stud 194. Drag links 194*a* are attached to a cylinder trunnion 195 with a trunnion pivot 195*a* and a tension pin 196. Two upper and two lower pivoting die holders 197 are pivotably mounted to the die block 193*a* with a pivot pin 198. During operation, fluid pressure is directed to the piston side of cylinder 192*a*. This action places drag link 194*a* in tension and rotates die holder 197 inwardly against a tubular workpiece. Serrated jaws 199 increase the friction, enabling the opposed die holders 197 and 193*a* to firmly clamp a tubular workpiece. An identical set of die holders 197*b* and 193*b* are located below the first set. The same clamping action takes place on the upper and lower die holders. Breakout cylinders 200 are pivotably attached to the upper section of the tool at 201*a* and 201*b*. The opposite end of the cylinder 200 is attached to the lower section of the tool. When the cylinders 200 are energized, opposite rotation occurs between the upper and lower sections of the tool. A male and female threaded tubular piece inserted within the jaws of the tool will be unscrewed.

Figure 18B:
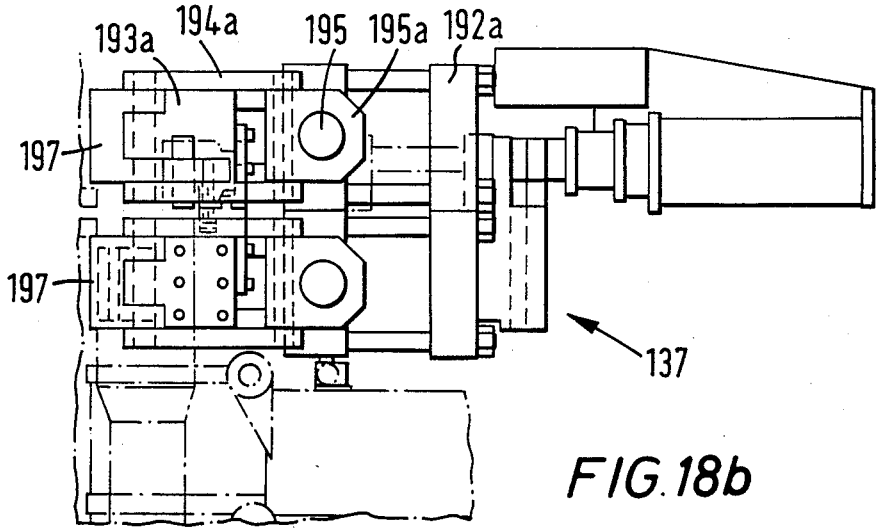

Referring to FIG. 19, there is shown a closed mode of the device of FIG. 18. FIG. 19*a* shows a sequential plan view of the relative position of the die holders 197 when open.

Figure 20:
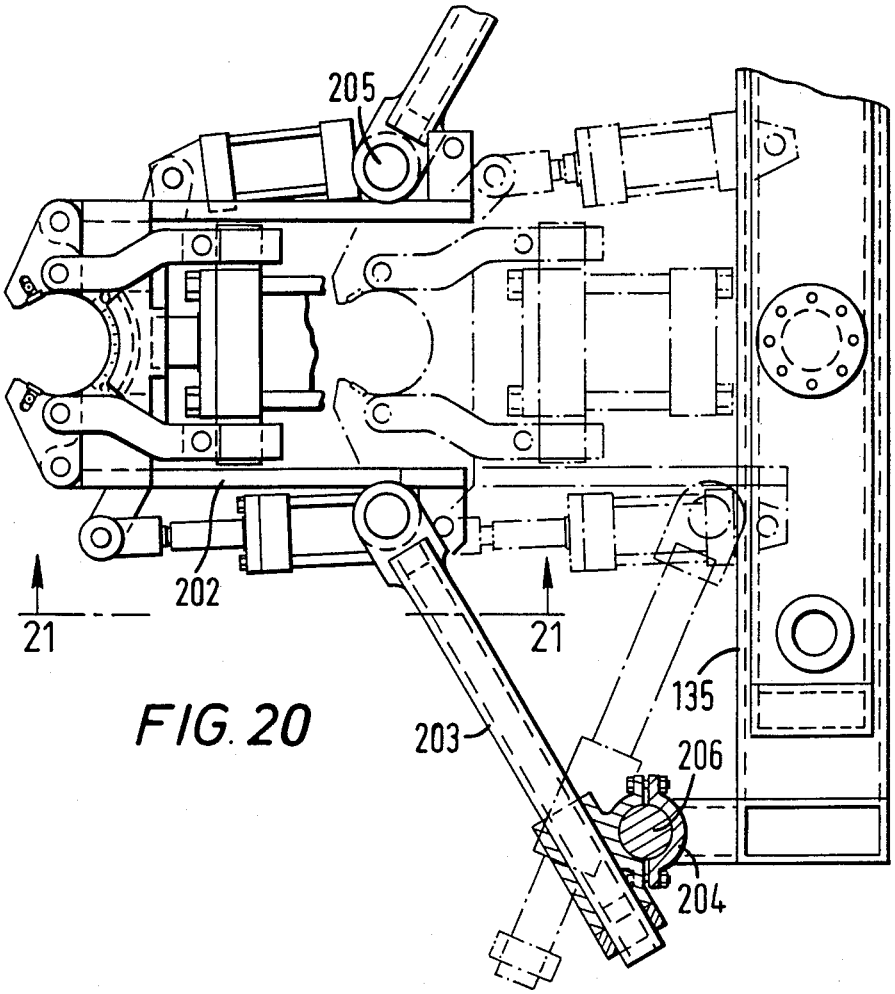
FIG. 20 is a plan view of the pipe wrenching device retracting mechanism and a partial view of the positioner frame.

Referring to FIG. 20, pipe wrenching device brackets 202 are shown firmly mounted to lower die holder 193*b*. Pinned to a bracket 202 is a support pivot 203 which is fitted to support a pivoting saddle 204 with pivot pins 205 and 206. When retract cylinder 143 is actuated, the pipe wrenching device will move away from the well centerline toward the mounting frame 135.

Figure 21:
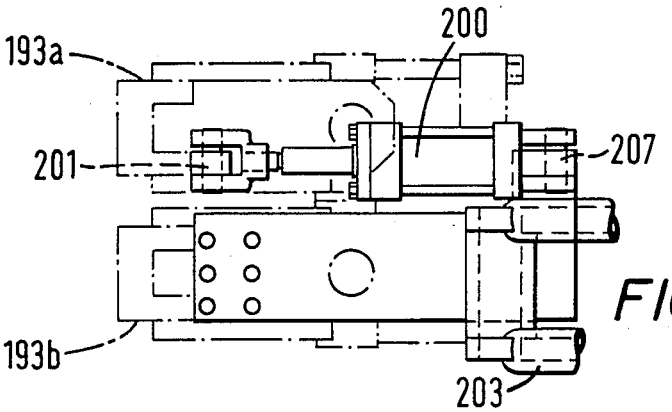
FIG. 21 side view of the wrenching device mounting and breakout cylinder.

Referring to FIG. 21, the cylinder 200 is attached to the lower die block at 207 and to the upper die block at 201. Compressing cylinder 201 imparts a rotary motion to the upper die block 193*a*.

Referring to FIG. 22, there is shown a cross sectional view through the centerline of pipe wrenching device 137 of FIG. 10*a*. The upper die block 193*a* is fabricated with a "TEE" section 207 on a radius 208 A slot 207 is machined on lower die holder 193*b* on radius 208 (FIG. 19). This produces a pivot point to maintain engagement of die holder halves 193*a* and 193*b* during breakout operations.

Figure 23:
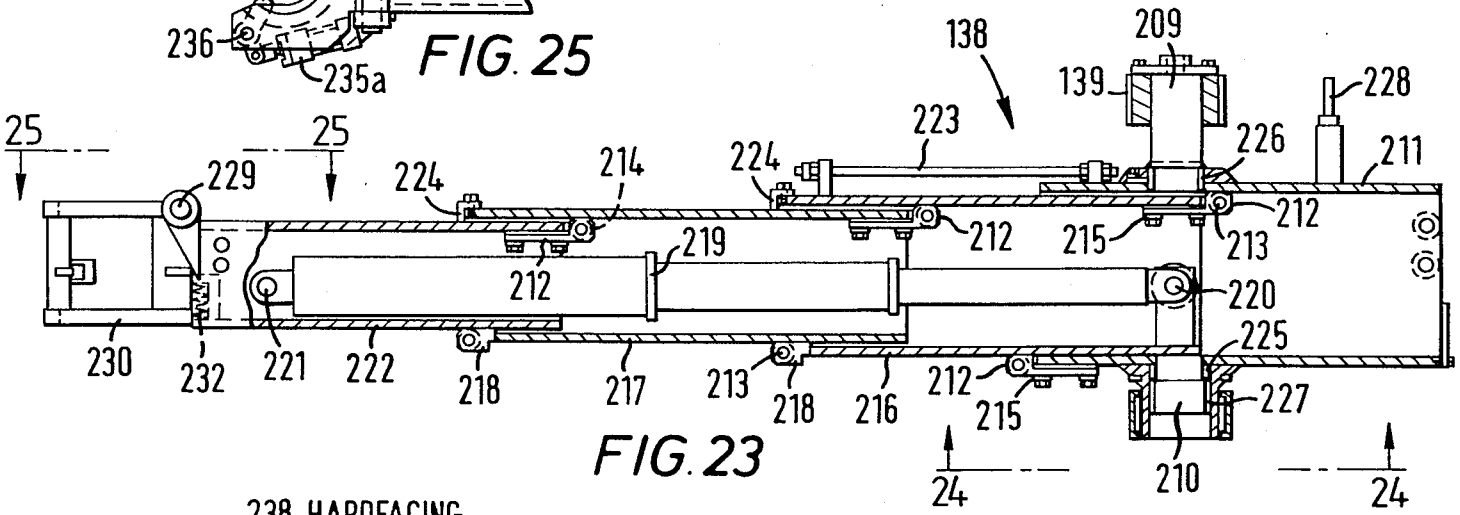
FIG. 23 is a cross section of the pipe positioner manipulator arm, a cross section of the gimball frame and a side view of the pickup bowl.

Referring now to FIG. 23, the telescoping drill pipe manipulator 138 for manipulating and positioning drill pipe (or other tubulars) to align them with the hollow drive shaft or well centerline has the gimball frame 139 and is bored to accept upper pivot pin 209 and lower pivot pin 210. These two pins are on the same centerline and effectively form a split axle for the manipulator rectangular section 211. Roller brackets 212, are fitted with roller shafts 213 and rollers 214. Shock absorbing pads 215 made of a resilient material are fitted at each location of brackets 212. Integral with rectangular sections 216 and 217 are roller brackets 218. A telescopic cylinder 219, is attached to one end of rectangular section 216 at point 220 and the opposite end is attached to rectangular section 222 at point 221. When cylinder 219 is compressed, rectangular sections 216, 217 and 222 telescope together creating a "first stage" position. When extending cylinder 219 stop rod 223 and stop blocks 224 limit travel. Rectangular section 211 is supported on a thrust bearing 225. Radial bearings 226 and 227 are installed for pivot shafts 209 and 210. Cylinder mount 228 is the attachment for manipulator rotate cylinder 242. Pipe pickup bowl 230 is attached to rectangular sections 222 with pivot pin 229. Springs 232 absorb shock loads placed on bowl 230. The pick up bowl 230 may be rotated 180° about the axis of pivot pin 229 if desired. When drilling it is often desirable to remove one length of drill pipe from the string. The pipe manipulator according to the present invention allows the loose end of the drill pipe to be picked up by an external hoisting line (not shown), fully horizontal. This facilitates the removal of the pipe from the drill floor.

Figure 24:
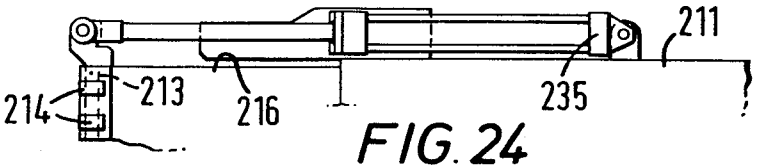
FIG. 24 is a lower view of the positioner arm showing a second stage retract cylinder.

Referring now to FIG. 24, a second stage retract cylinder 235 for retracting the pipe manipulator away from the well centerline is shown mounted to rectangular section 211 at one end and to rectangular section 216 at the opposite end. Rollers 214 are installed with a pin 213.

Figure 25:
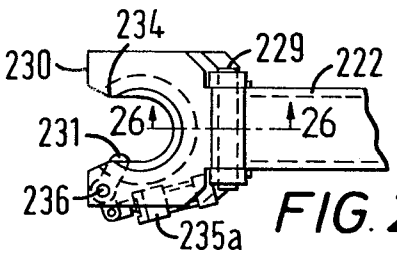
FIG. 25 is a detail plan view of the positioner pick up bowl.

Referring to FIG. 25, the pick up bowl 230 is mounted on pivot pin 229. An open front 234 of the bowl 230 will allow the entry of a tubular element. A latch arm 231 is attached with pivot pin 236. A latch cylinder 235*a* is actuated to extend, rotating the latch arm inwardly. The latch arm 231 is fail safe toward closed position.

Figure 26:
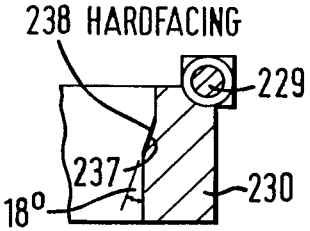
FIG. 26 is a sectional view of the pick up bowl.

Referring to FIG. 26, a cross-section of the pick up bowl 230 shows the 18° tapered seat 237 which is preferably undercut and hard faced at 238.

Figure 27:
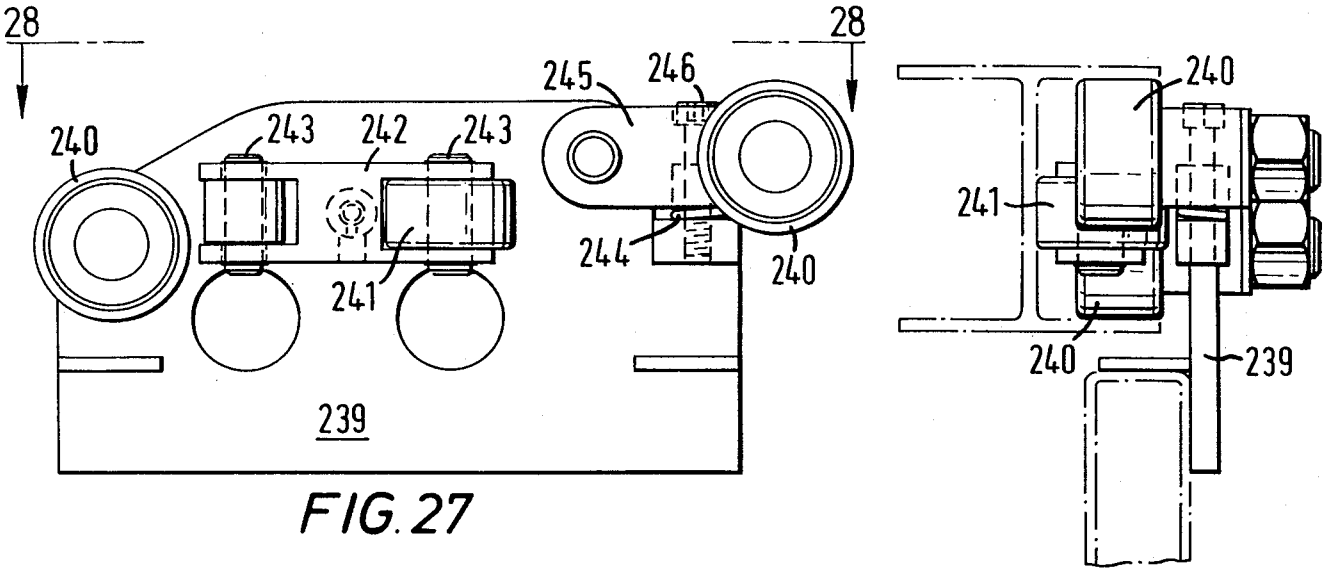
FIG. 27 is a side elevation of the positioner mounting frame roller bracket assembly.

Referring to FIG. 27, a partial view of the mounting frame rollers 240 and 241 is shown. An idler arm 242 is fitted with a roller bearing wheel 241 and is then attached by a pin 243 to a roller bracket 239. Cam follower roller bearing wheels 240 are attached to the idler arm and roller bracket 239. A compression spring 244 beneath idler arm 245 allows the distance between rollers 240 to vary and also will absorb shock loads. Spring tension is controlled by adjustable bolt 246.

Figure 28:
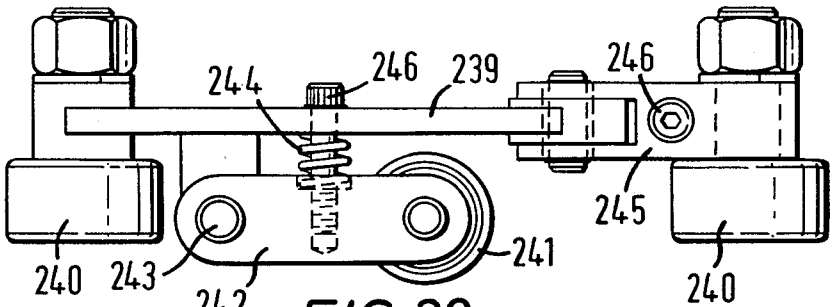
FIG. 28 is a top view of the roller bracket assembly.

Referring to FIG. 28, (a top view of the items of FIG. 27), the idler arm 242 is fitted with compression spring 244 and bolt 246. When installed, the idler arm 242 may then pivot about the pin 243. Spring tension is controlled by bolt 246.

Figure 29:
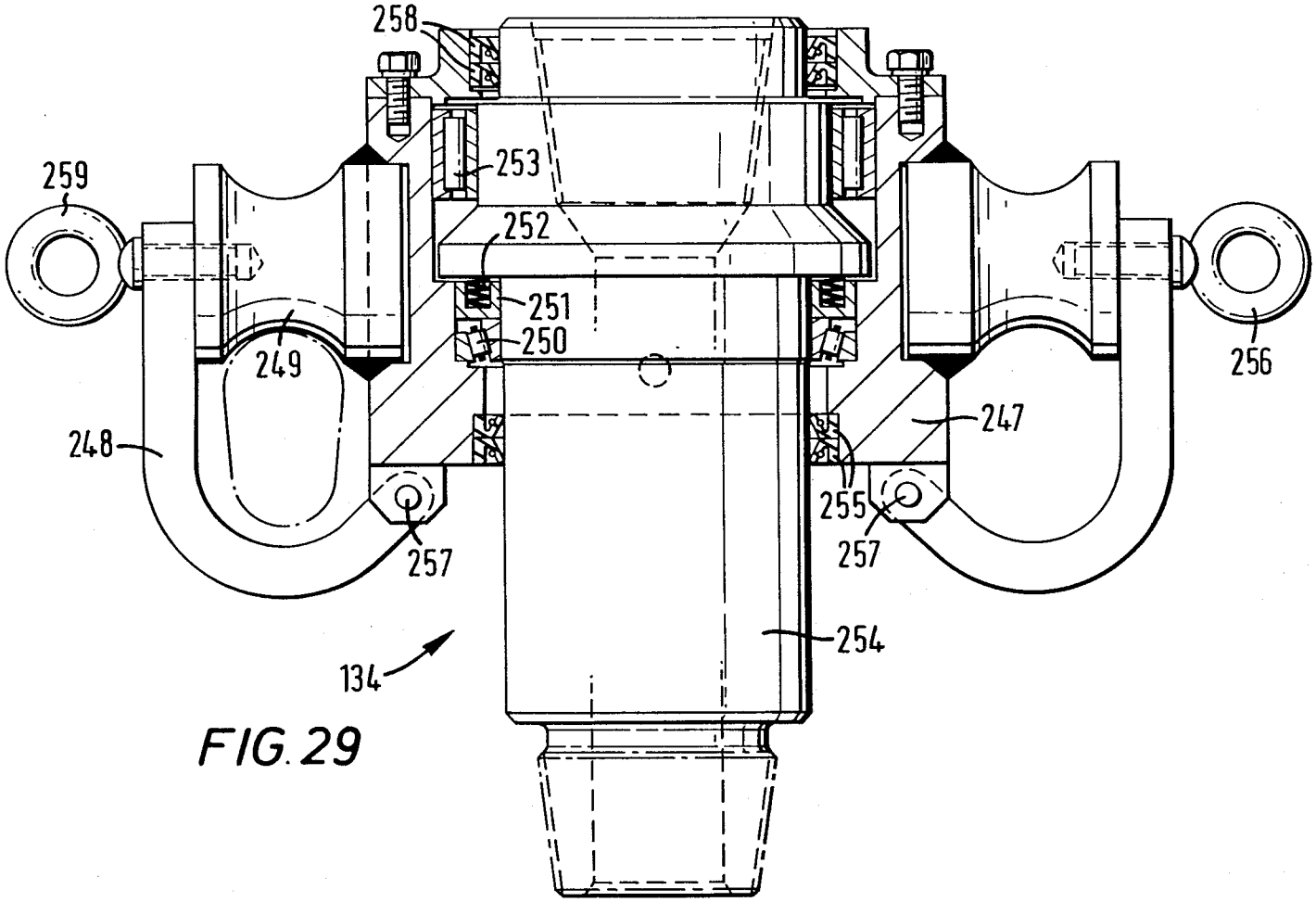
FIG. 29 is a sectional view of the elevator link adapter (34).

Referring to FIG. 29, in the elevator link adaptor 134 a tubular threaded element 254 is installed in a link adapter housing 247. A bearing 253 provides radial support and bearing 250 provides longitudinal support. A spring cage 251 and compression springs 252 provide a cushioned pad between the bearing 250 and the support shoulder of tubular element 254. The link support 249 is contoured to suit a standard elevator link. Sealing elements 255 and 258 isolate the internal parts from the outside. A link retainer 248 is attached with a pin 257 and an eyebolt 256. When housing 247 is externally restrained, the tubular element 254 is then free to rotate within the stationary housing.

The top drive apparatus according to the present invention compare very favorably with the prior art drive apparatuses. The following chart compares certain features but not all of the top drive according to the present invention to the top drive embodying features disclosed in U.S. Pat. No. 4,449,596 and to the Bowen ES-7 Electric Drilling Swivel (U.S. Pat. No. 3,766,991):

| Prior Art | THE PRESENT INVENTION |
|---|---|
| Electrical power is conducted from the generating room to the unit through rubber covered electrical cables. Danger of damaging and sparking is ever present. An accident at a time when well head gases are present could be disa strous. | Operated by hydraulic fluid. There is no danger of sparking. The hydraulic power unit is located in a safe area. |
| Complete drilling system weighs approximately 20 tons. | Complete system weighs 10 tons or less. |
| In the event of mechanical failure requires complete "rig down"; the replacement of the top drive assembly would be more complex. | Unit is designed to accommodate rapid replacement of the hydraulic Top Drive. Because of this feature several hours of down time are saved. |
| User confidence in the reliability of this unit is not high. Consequently, all installations are equipped with a conventional lrotary table drive system on "standby". | Reliability of this system would allow users to eliminate the rotary table drive systems; spare hydraulic motors and components are the only "back-up" equipment. This saves hundreds of thousand dollars rig cost. |
| Hazardous area certificates are required for the numerous safety devices used to monitor systems designed to render this unit safe for use in a hazardous location. This is time consuming and expensive. | Electrical devices are located below the drill floor in a pressured safe room which already exists. The multitude of monitoring devices used on the electric drive are not required. |
| During drilling, excessive bit weight or hole friction stalls out the electric motor and stops the drill bit. Common practice is to reduce bit weight. Since full electrical potential remains applied, the drill suddenly accelerates from zero to up to 250 R.P.M. in a matter of seconds. This causes overtightening of tool joint threads and ruins the drill pipe. Also the drill string may whip and damage the wall of the hole. Mechanical reaction is transmitted to the derrick through the support mechanisms and this vibration damages the structure and is very noisy. | Fluid power because of its inherent nature is much smoother. The mechanics of the moving fluid are such that acceleration after stall will be smoother and uniform. Less damage to drill hole and equipment are realized. |
| Air purging the inside of the electric drilling motor is required at initial start-up and at every time a safety device actuates. This may require 10 to 30 minutes. | No purging is required because there is no air cooling system. |
| While drilling, full voltage and amperage is applied to the motor. If the drill pipe should break, the electric motor will suddenly go to an overspeed condition because of the electrical potential. If the break is above the drill floor, the shipping of the drill pipe could cause much damage and possibly death. | Hydraulic motors will not speed up unless the flow is increased. This will not happen simply because of a drop off in load. |
| On units so equipped there is a danger of water leaking into the electric motor following any damage or corrosive failure of the water to air heat exchanger used to cool the motor air. These systems are required wherever you find stringent safety measures such as North Sea Platforms. This can cause the motor to fail. | No such system is required. |

-continued

| Prior Art | THE PRESENT INVENTION |
|---|---|
| Making drill pipe connection: The drill pipe is picked up by the elevator bowl and the lower end stabbed in the previous pipe. Human skill is then required to ease the drive shaft down into the thread to screw it up. Thread damage can occur. | The pipe handling device on this unit has a hydraulic lift to engage the thread. Proper adjustment will ensure minimal pressure on the threads. This is much quicker than when the driller has to execute skill and judgment making up each joint of pipe. |
| When picking up a length of drill pipe whose end is protruding about 3 ft. above the drill floor, the pipe handler must be tilted outward. Since the bowl of the pickup tool is swiveled, the angle is incorrect for the pipe. Also the latches on the pickup tool must be manually closed which takes time. | Perfect alignment and orientation of the pipe handling mechanism is achieved via mechanical stops and cylinders to create the necessary movement. The latch is spring loaded to automatically lock when the pipe is loaded. A cylinder will actuate the latch to the open position. This is by remote control which is much safer. This system is also much faster than the manual method. |
| Cost much more. | This system costs much less. This does not take into account the equipment which an operator does not have to buy, such as extra swivel and/or rotary table drives which would make the savings several hundred thousand dollars. |
| Installing this unit on land rigs or retrofitting to offshore rigs is very complicated because of size and different system. | Retrofit to any existing drilling rig can be accomplished much easier because of size and weight as well as simplicity of design. |
| The closed circuit air cooling system collects carbon dust which erodes from the bushes. This can lead to internal shorting. | No brushes are used. |
| Repeated stalling of the main electric motor especially for more than a few moments, under high swivels because one is in be used when unit is rigged down. Under high current will damage the armature and subsequent rotation will lead to failure. | No such stalling problem. |

Also, the top drive apparatus of the present invention compares favorably to a top drive embodying certain features of the device disclosed in the prior art U.S. Pat. No. 4,449,596 in the following respects:

-continued

| Prior Art | The Present Invention |
|---|---|
| Requires two circulating swivels because one is integral with power sub and one must be used when unit is rigged down | Only one swivel is required. Current list price for a 500 ton swivel 1Continental Emsco: $43,290.00 |
| Requires explosion proof cooling air system. Present design uses blower mounted on support dolly or drill floor and air is conducted through 8" flexible rubber duct. This lightweight duct is often windblown and damaged from hanging on the rig structure. Hot air is exhausted to atmosphere creating a hazardous condition. Documentation for the alternating current fan motor and approval for the D.C. drive motor is time consuming and expensive. | Hydraulic oil is cooled by rig supplied water being circulated through an oil cooler. This equipment is located in an existing safe location. |
| The overall height, width and depth is much greater; requires approximately 46 ft. of vertical derrick height. | This unit requires less than 36 ft. |
| The unit does not have a "rise and fall" mechanism to minimize load on drill stem threads when unscrewing. | Counterbalance mechanism is provided. |
| Unit must be swung back in order to install well casing. | All normal drilling and casing installation is done with standard unit. |

While certain specific embodiments of the present invention have been disclosed, the invention is not limited to these particular forms, but is applicable to all variations which fall within the scope of the following claims:

What is claimed is:

1. In combination with a well derrick, an apparatus for working with a string of pipe or with other tubular members, the apparatus comprising hydraulic top drive means having a drive shaft, the shaft matable with the pipe of a pipe string for supporting and rotating the string, frame means movably connected to the derrick for movement up and down within the derrick, and pivot means for pivotably mounting the top drive means to the frame means so that at whatever height within the derrick the frame means is positioned the top drive means is levelly pivotable on the frame means in a horizontal plane away from the vertical axis of the derrick, pipe wrenching means mounted on the frame means for making up and breaking out connections of the top drive shaft and the string, the pipe wrenching means connected to the frame means independently of the top drive means, the pipe wrenching means pivotably mounted to the frame means so that it is levelly pivotable in a horizontal plane away from the vertical axis of the derrick, the pipe wrenching means pivotable independent of the top drive means, and the pipe wrenching means having dual sets of jaws, one set above the other, each set operable independently of the other.

* * * * *